US005188187A

United States Patent [19]

Mumper

[11] Patent Number: 5,188,187

[45] Date of Patent: Feb. 23, 1993

[54] ELECTRICAL GROUNDING ROD DRIVING BIT

[75] Inventor: James O. Mumper, Tiffin, Ohio

[73] Assignee: E & J Demark, Inc., Wauseon, Ohio

[21] Appl. No.: 754,456

[22] Filed: Oct. 9, 1991

[51] Int. Cl.[5] ..... B25D 1/00; B25D 1/02

[52] U.S. Cl. ..... 173/128; 173/132

[58] Field of Search ..... 173/90, 128, 130, 131, 173/132; 227/147

[56] References Cited

U.S. PATENT DOCUMENTS

| | | | |
|---|---|---|---|
| D. 261,098 | 10/1981 | Hendon et al. | D8/70 |
| 2,147,829 | 2/1939 | Daniels | 173/132 |
| 4,315,551 | 2/1982 | Iannone | 173/128 |
| 4,460,050 | 7/1984 | Schmidt | 173/128 |
| 4,557,409 | 12/1985 | Hecock et al. | 227/147 |

*Primary Examiner*—Mark Rosenbaum
*Assistant Examiner*—John M. Husar
*Attorney, Agent, or Firm*—Stevens, Davis, Miller & Mosher

[57] ABSTRACT

The present invention comprises an electrical grounding rod driving tool for use with an externally powered hammer comprising a shaft portion for insertion into a tool receiving chuck of the hammer and a base portion extending outwardly from said shaft portion which receives and retains the end of a grounding rod to which the powered hammer is applied. The base portion comprising an inwardly extending elongated tapering bore from the exterior end of said base portion which bore is identified as a conical bore, the interior terminus of said bore being truncated and terminating in a concave cap, the outer circumference of which is in tangential relationship with the walls of said inwardly extending conical bore. The diameter of said bore at said exterior is greater than the original exterior diameter of the rod to be driven, the diameter of said bore at the truncated terminus being less than the original diameter of said rod. The bore in the base portion having an inwardly extending length of approximately one-half the length of the base portion of the tool.

2 Claims, 2 Drawing Sheets

FIG. 1
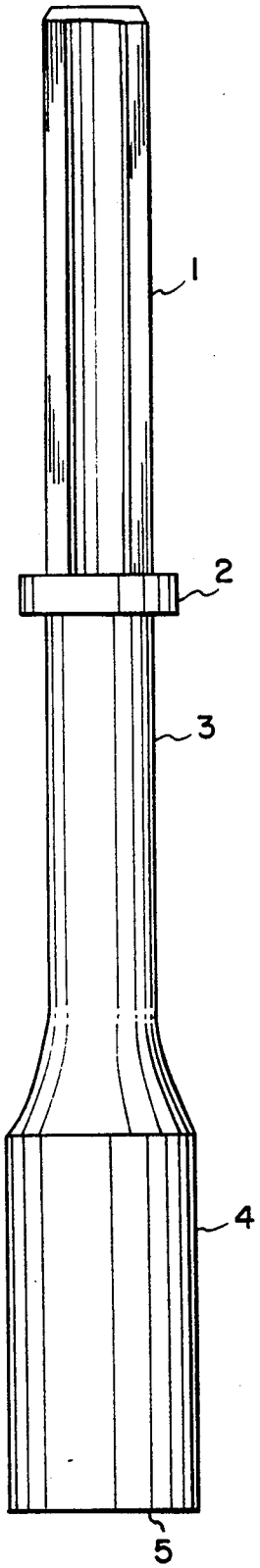
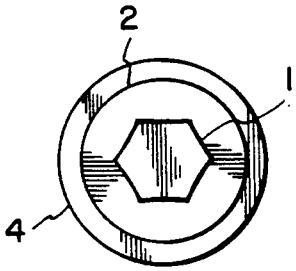
FIG. 2
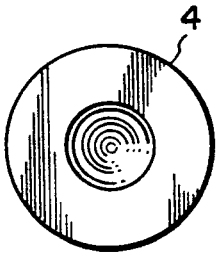
FIG. 3
FIG. 4
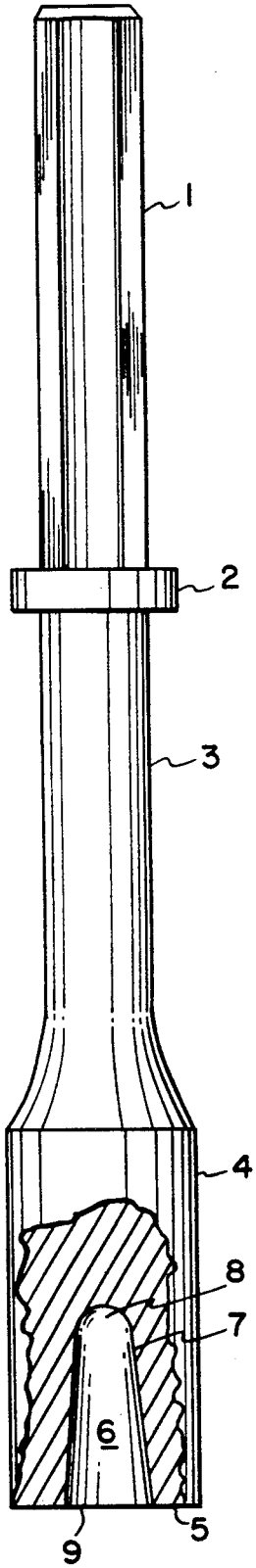

ELECTRICAL GROUNDING ROD DRIVING BIT

FIELD OF INVENTION

The present invention is in the general field of the transmission of electrical power. More specifically, it is in the field of the insertion of electrical grounding rods into the earth.

BACKGROUND OF THE INVENTION

For safety, the transmission of electrical power requires that the transmission lines, whatever the voltage being transmitted, have grounding connections to minimize or eliminate unforeseen static charge build-up or power surge from outside forces, such as lightning strikes on the transmission lines, towers or poles. In the instances where the electrical power is being supplied to a residence or office or business building, adequate grounding can usually be made by utilizing the water supply line laid in the earth. Where a large quantity of voltage is involved, it is customary to use an approved grounding rod, normally a nominal ⅝ inch in diameter and of a length of 8 to 10 feet. In some areas of the country rods of a nominal ½ inch are used and those rods are normally galvanized steel. The 158 inch rods are galvanized steel or copper cladded steel rods. A single rod such as this is usually driven into the ground using a hand-operated driving hammer such as disclosed in U.S. Pat. Nos. 4,557,409 and 4,315,551.

However, in many areas of the country it is necessary to drive grounding rods to a depth greater than the length of one rod. When it is necessary to drive two or more grounding rods into the earth to achieve appropriate grounding the successive rods must be mechanically coupled to ensure continuing electrical contact. Such coupling is done by employing one or more special coupling units which may be generally described as a sleeve of electrically conductive metal having an interior of a plurality of lands and grooves, the sleeves having opposing exterior end of diametrical openings slightly in excess of the normal diameter of the driving rod with an inwardly tapering bore having a diameter slightly less than the nominal diameter of the grounding rod. For such couplings, standard in the industry, to be usable it is imperative that the end of the grounding rod being impacted to insert the rod insertor into the earth not be deformed to a diameter greater than the diameter of the exterior opening of the connecting sleeve, referred to as "mushrooming" in the trade.

Tests using the electrical rod driver disclosed in FIG. 2 of U.S. Pat. No. 4,315,551 in driving rods into frozen earth resulted in the "cold weld" capture of the grounding rod. This means destruction of this driver in order to accommodate the coupling previously mentioned. The driver shown in FIG. 4 of this patent was not available for testing. However, experience in this field and analysis of the "accept all diameters of rods" shown in FIG. 4 results in the technical conclusion that the driven end of the rod within FIG. 4 recess may not result in a "cold weld" of the driven end but the so-driven drive result will be an increased diameter of the driven end of the rod to the extent that the standard coupling for joining successive driven rods cannot be used. The only solution in such a situation is to use the labor intensive, time-consuming welding of the two rod ends which may not be permanent in view of the continuous successive power blows upon the rod end. The alternative would be to cut the end of the grounding rod welded in the interior of the driving device previously described and install the so-cut end into one side of the aforementioned coupling device and place this coupling over the end of the grounding rod next to be inserted into the earth. Depending upon the resistive nature of the ground, such as frozen ground or very dense, compacted clay soils, hand-driving is not practical nor effective. In such instances it is necessary to use powered driving means, usually operated by a pressurized fluid such as a commercial impact hammer. When more than one rod is required to obtain the desired grounding, successive rods are driven in, coupled together and the procedure continued until the required grounding is obtained.

Up to the present time, such rods are driven into the earth by continuously impacting the upper end of the rod with a vertically reciporcating impact hammer. Such multiple impacting on the top of the rod, particularly in frozen soil or compacted clay soil tends to "upset" or "mushroom" the rod end to the degree that the couplings in use could not be fitted over the "upset" end. To permit use of a coupling in such instance, it was necessary to cut off the upset end of the rod. To overcome such upsetting of the rod end and necessary removal of the upset end of the rod the anvil head was provided with a cylindrical bore of a fractionally greater diameter to receive the end of the rod and hopefully to limit the mushroom formation of the rod end as disclosed in U.S. Pat. No. 4,315,551. Such fractional diametrical difference continued to allow the end of the rod to be upset under deep driving conditions with the result that the end of the rod in the bore which terminates in a cupola effected a cold weld with the anvil head that made it impossible to separate the rod from the anvil, again requiring the rod to be cut off and installing a new driving anvil for each successive rod.

This patent also discloses an anvil with a rod-receiving bore which can accommodate a plurality of rod diameters. Experience in the field indicates that the anvil bore must firmly hold the rod being driven and not permit any wobbling within the bore.

SUMMARY OF THE PRESENT INVENTION

The present invention comprises an electrical grounding rod driving tool for use with an externally powered hammer comprising a shaft portion for insertion into a tool receiving chuck of the hammer and a base portion extending outwardly from said shaft portion which receives and retains the end of a grounding rod to which the powered hammer is applied. The base portion comprising an inwardly extending elongated tapering bore from the exterior end of said base portion which bore is identified as a conical bore, the interior terminus of said bore being truncated and terminating in a concave cap, the outer circumference of which is in tangential relationship with the walls of said inwardly extending conical bore. The diameter of said bore at said exterior is greater than the original exterior diameter of the rod to be driven, the diameter of said bore at the truncated terminus being less than the original diameter of said rod. The bore in the base portion having an inwardly extending length of approximately the length of the base portion of the tool.

BRIEF DESCRIPTION OF THE DRAWINGS

The present inventive concept is shown in the accompanying drawings as illustrative of the invention.

FIG. 1 is an elevation view of the present invention, the view from all sides being identical.

FIG. 2 is a top plan view of the present invention.

FIG. 3 is a bottom plan view of the present invention.

FIG. 4 is an elevation view in partial cross-section of the present invention.

DETAILED DESCRIPTION OF THE INVENTION

Figure 5:
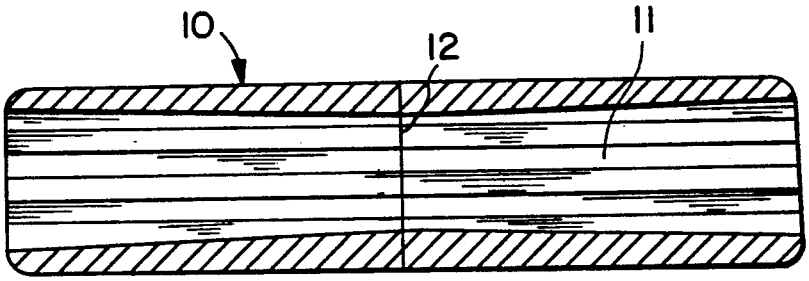
FIG. 5 is a cross-sectional view of a ground rod coupler.
Figure 6:
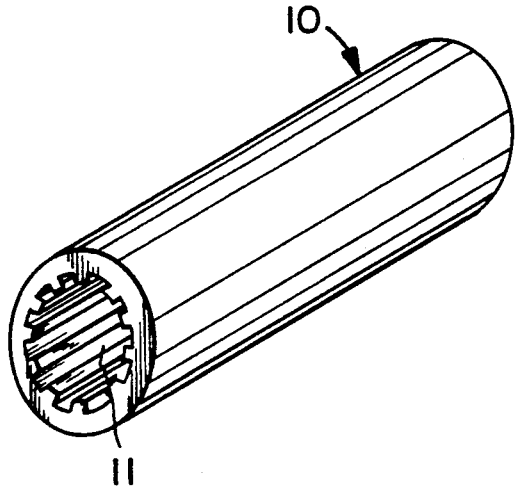
FIG. 6 is a perspective view of the coupler in FIG. 5.

Referring to FIGS. 1–4, the present invention comprises an elongated first shaft portion 1, a stop collar 2 to cooperate with the conventional stop means on the interior of the chuck to retain the shaft in the chuck after insertion of shaft 1 into the bit receiving chuck of a powered hammer (not shown), a second elongated shaft portion 3 extending outwardly from said collar 2 to position the grounding rod receiving and retaining base portion 4. Base portion 4 carries an elongated inwardly extending tapering or conical bore 6 from the base 5 of portion 4 having an interior terminus 7 which is truncated and capped with a concave surface 8, the outer circular edge of this surface having a tangential relationship with the interior terminus 7 of said conical bore 6. The bore 6 external opening 9 has a diameter 9*a* larger than the diameter of the grounding rod to be driven. The bore diameter 7*d* at the inner terminus 7 of bore 6 is slightly less than the rod diameter as is surface 8 diameter.

The taper of the bore 6 is in fact a double taper. At the terminus there is a short taper length 7*a* of approximately ¼ inch leading from the concave surface 8, length 7*a* having a diameter 7*c* at its juncture with taper length 7*b* which is fractionally greater than the diameter 7*d* of concave surface 8. As can be seen in FIG. 4, the length of bore 6 is substantially equal to the length of base portion 4. The diameters of the bore will of course vary depending upon the size of the grounding rod, i.e., ½ inch copper, ½ inch galvanized, ⅝ inch copper, ⅝ inch galvanized, ¾ inch copper, etc. The following table indicates these variants.

| Diameter | 7c | 7d | 9a |
|---|---|---|---|
| ½ inch copper | .455" | .44" | .77" |
| ⅝ inch copper | .6270 | .612 | .927 |
| ⅝ inch galvanized | .6270 | .612 | .88 |

It can be seen that diameter 9*a* is approximately 50% greater than diameter 7*d*. This facilitates not only insertion of the rod end into the bore but also extraction of the rod end after driving since there is often a tight fit within internal terminal end of the bore.

The configuration of this bore results in the end of the rod being struck having a matching configuration. This is important when viewing the coupler 10 seen in FIG. 5. It is to be noted that the bore 11 of the coupler 10 tapers inwardly from each end to the internal midpoint 12 of the coupler.

What is claimed is:

1. An electrical grounding rod driving tool to drive a grounding rod for use with an externally powered hammer comprising a first shaft portion for insertion into a tool receiving chuck of said hammer, a stop collar capable of cooperating with said chuck to retain said shaft portion in said chuck after its insertion therein and a base portion having an elongated inwardly extending conical bore with a truncated interior terminus which is capped with a concave surface in tangential contact with said truncated terminus.

2. The driving tool according to claim 1 wherein said bore has a diameter at its external end in said base portion larger than a diameter of said grounding rod to be inserted, said grounding rod having an end which upon insertion as far as possible contacts said truncated terminus and said concave surface in tangential contact with said truncated terminus, said bore further having a diameter at said truncated interior terminus which is slightly less than said diameter of said grounding rod.

* * * * *